US006056333A

United States Patent [19]

Wach

[11] Patent Number: 6,056,333

[45] Date of Patent: May 2, 2000

[54] FLOATING LATCH MECHANISM

[75] Inventor: Joseph Wach, Ingleside, Ill.

[73] Assignee: Illinois Tool Works Inc., Glenview, Ill.

[21] Appl. No.: 09/149,207

[22] Filed: Sep. 8, 1998

[51] Int. Cl.[7] ..... E05C 1/04

[52] U.S. Cl. ..... 292/145; 292/DIG. 4; 292/137

[58] Field of Search ..... 292/DIG. 4, 137, 292/138, 145

[56] References Cited

U.S. PATENT DOCUMENTS

| | | | |
|---|---|---|---|
| 3,156,493 | 11/1964 | Griffiths | 292/DIG. 4 X |
| 3,854,784 | 12/1974 | Hunt et al. | 312/319 |
| 4,641,747 | 2/1987 | Mestdagh et al. | 206/309 |
| 4,702,506 | 10/1987 | Iimura | 292/251.5 |
| 4,917,416 | 4/1990 | Westphal et al. | 292/175 |
| 5,211,431 | 5/1993 | Koizumi et al. | 292/81 |
| 5,498,039 | 3/1996 | Bivens | 292/145 |

*Primary Examiner*—Teri Pham

*Attorney, Agent, or Firm*—Pitney, Hardin, Kipp and Szuch LLP

[57] ABSTRACT

The push—push latch mechanism includes a latching body which includes a mouth, first camming walls, second camming walls, third camming walls, an inlet channel, an outlet channel and a detent island. During the latching cycle, the user pushes the door or other structure attached to the pin and the pin enters the mouth of the latching body and is guided by first camming walls to the inlet channel and second camming walls. The user then releases the door or other structure attached to the pin and the pin travels to detent engagement with the island. During the unlatching cycle, the user again pushes the door or other structure attached to the pin and the pin travels from detent engagement with the island to third camming walls which guide the pin to the outlet channel. The pin traverses the outlet channel and exits the mouth of the latching body.

15 Claims, 3 Drawing Sheets

FLOATING LATCH MECHANISM

BACKGROUND OF INVENTION

1. Field of Invention

This invention pertains to a floating latch mechanism with camming walls which implement a push—push configuration.

2. Description of the Prior Art

In the prior art, latch mechanisms which use a "push—push" arrangement are known. That is, these latches are fastened by a pushing action by the user, and subsequently unfastened by a similar or identical pushing motion. However, these prior art latch mechanisms include a relatively large number of pieces and are therefore complicated to manufacture, assemble and install. This added complexity translates into higher costs.

Additionally, users immediately recognize and appreciate when a "push—push" latch has a robust feel. That is, solid, clear and reliable operation is appreciated by the user. Sometimes the prior art "push—push" latches have been left room for improvement in this regard, particularly if the latches were not self-aligning and used springs to align the latch.

Examples of prior art mechanisms with a large number of parts are disclosed in U.S. Pat. No. 4,449,022 entitled "Self-Holding Type Push Switch with Heart Type Cam" issued on May 15, 1984 to Uno et al. and U.S. Pat. No. 4,404,436 entitled "Push—Push Mechanism of Pushbutton Operating Shaft" issued on Sep. 13, 1983 to Ohba.

OBJECTS AND SUMMARY OF THE INVENTION

It is therefore an object of the present invention to provide a "push—push" latch mechanism with a reduced number of parts.

It is therefore a still further object of this invention to provide a "push—push" latch mechanism with a low cost of manufacture.

It is therefore a still further object of this invention to provide a "push—push" latch mechanism which has a solid, reliable and robust feel to the user.

It is therefore a still further object of this invention to provide a self-aligning latch which minimizes or reduces the use of springs for alignment purposes.

These and other objects are attained by providing a "push—push" latch which includes a rectangular latching body which travels within a pair of parallel slots. The latching body further includes sidewalls which form a mouth, first camming walls, second camming walls and third camming walls. A detent island is formed within the sidewalls which divides an inlet channel from an outlet channel, both of which are in communication with the mouth of the latching body. During the latching cycle, the user pushes the door to which a pin is attached so that the pin enters the mouth and the engagement of the pin against the first camming walls moves the latching body so that the pin enters the inlet channel. The engagement of the pin and the second camming walls thereafter moves the latching body so as to align the pin proximate to the detent island. The user then feels that the door is fully closed and releases the door. The pin, which is biased, thereafter engages the detent island. During the unlatching cycle, the user again pushes the door which urges the pin from the detent island to third camming walls. The engagement of the pin and the third camming walls moves the latching body so as to align the pin with the outlet channel. The user again feels that the door is fully closed and releases the door. The pin thereafter travels through the outlet channel and the mouth free of the latching body.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENTS

Figure 1:
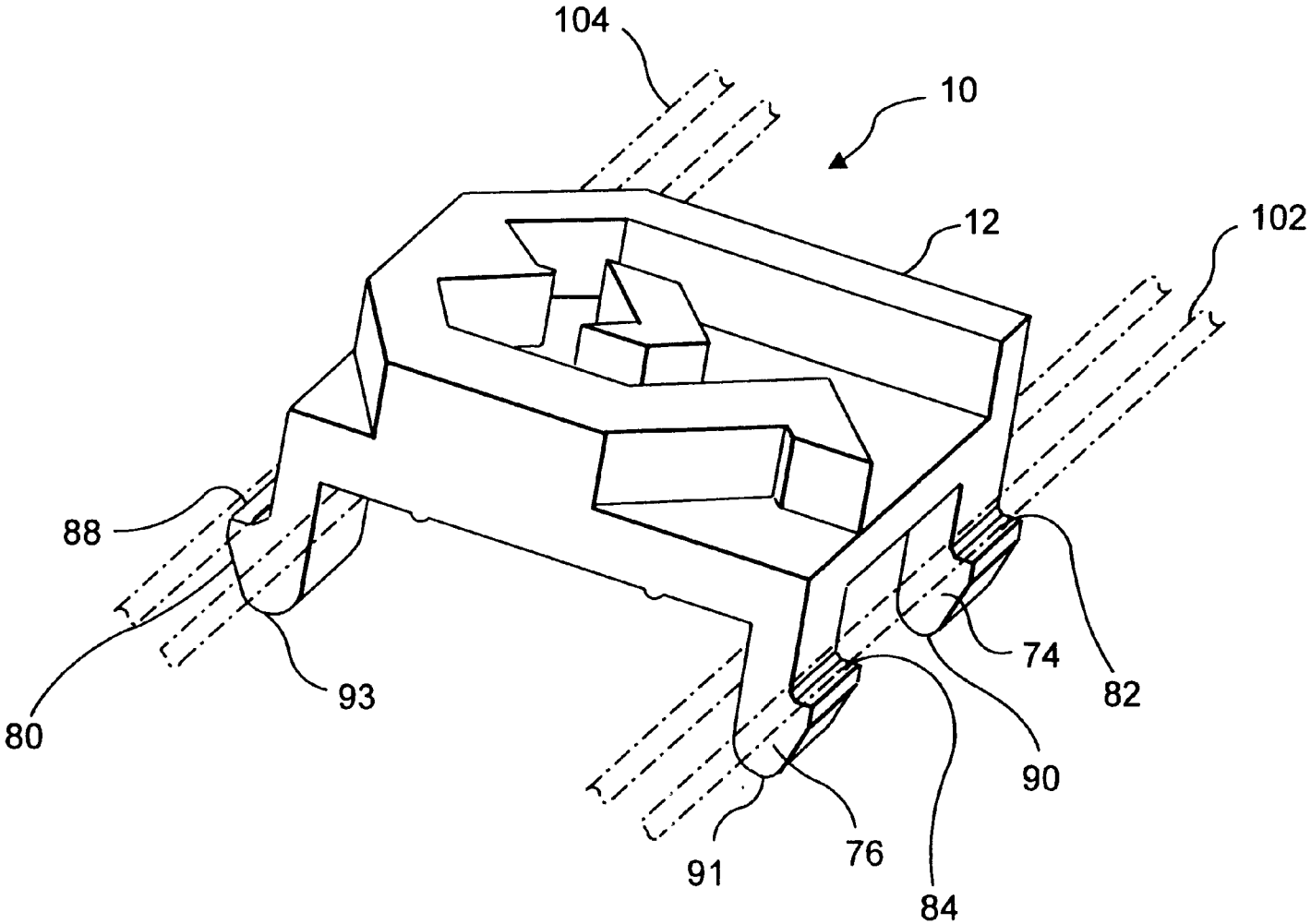
FIG. 1 is a top perspective view of the latch mechanism of the present invention, with the slots in which the latching body traverses shown in phantom.
Figure 4:
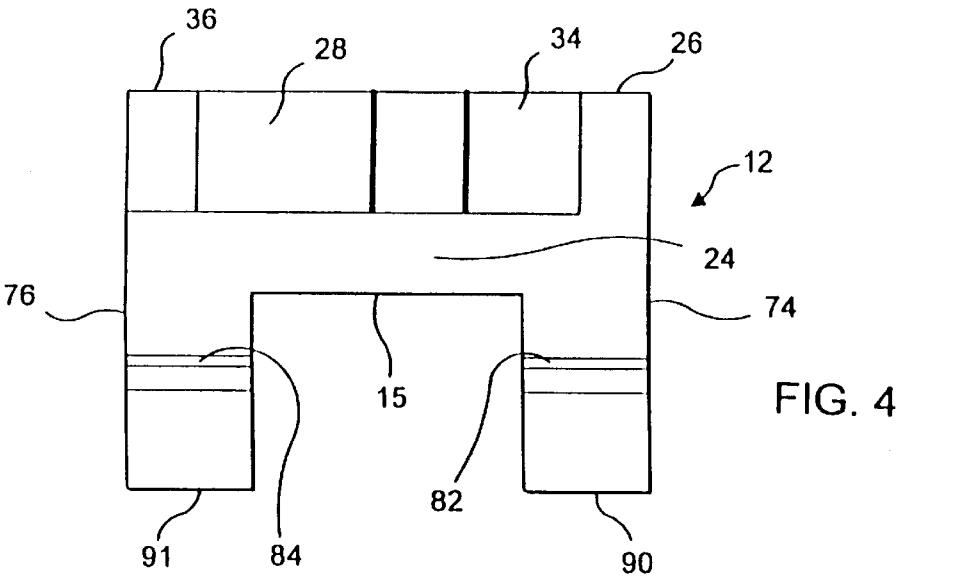
FIG. 4 is a front plan view of the latching body of the latch mechanism of the present invention.
Figure 3:
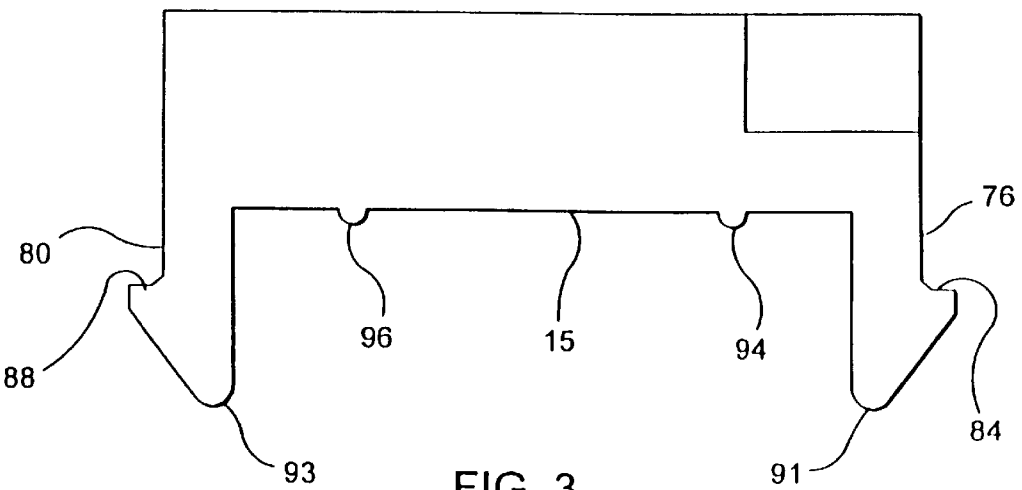
FIG. 3 is a side plan view of the latching body of the latch mechanism of the present invention.

Referring now to the drawings in detail wherein like numerals refer to like elements throughout the several views, one sees that FIG. 1 is a top perspective view of the latch mechanism 10 of the present invention, with the latching body 12 shown traversing slots 102, 104 of body 100. Latching body 12 is designed to latch to pin 200 which is shown in phantom in FIG. 5 in various relative positions A–L during the latching and unlatching cycle. Body 100 is typically part of a relatively stationary structure, such as an automobile dashboard, while pin 200 is typically secured to a relatively movable structure, such as the door of a glove compartment.

Figure 2:
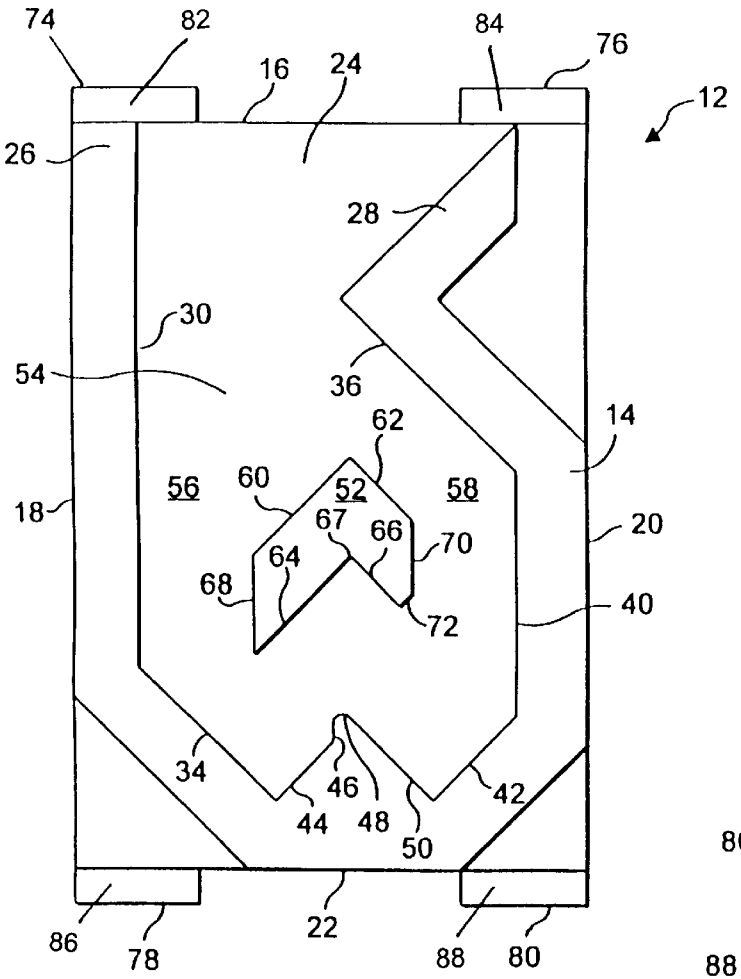
FIG. 2 is a top plan view of the latching body of the latch mechanism of the present invention.
Figure 5:
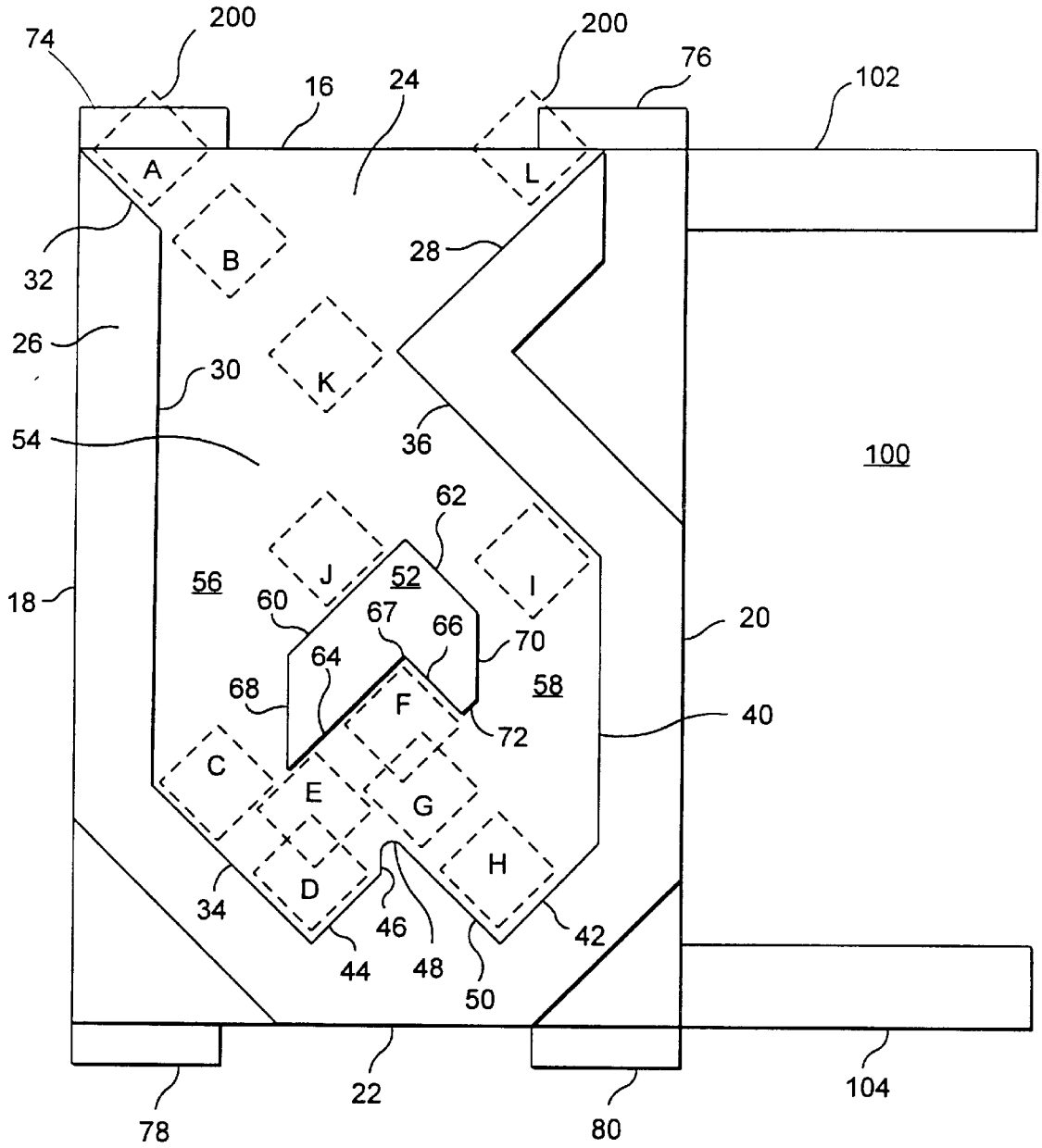
FIG. 5 is a top plan view of the latching body traversing the slots of the latch mechanism of the present invention with the various relative positions A through L of the pin shown in phantom during the latching and unlatching cycle.

As shown in the orientation of FIG. 2, latching body 12 has generally rectangular planar base 14 formed by upper wall 16, sidewalls 18, 20 and lower wall 22. Upper wall 16 includes mouth 24 formed between lateral camming wall 26 on sidewall 18 and first upper oblique camming wall 28 formed inwardly from sidewall 20. Lateral camming wall 26 is illustrated in FIGS. 1 and 2 as having an interior edge 30 parallel with sidewall 18. However, as illustrated in FIG. 5, lateral camming wall 26 can further include a second upper oblique camming wall 32 proximate to mouth 24. Lateral camming wall 26 joins first lower oblique camming wall 34 which extends inwardly adjacent from the intersection of sidewall 18 and lower wall 22.

FIG. 2 illustrates first upper oblique camming wall 28 joining intermediate oblique camming wall 36 at substantially a right angle which is the preferred angle, but other angles are possible. Intermediate oblique camming wall 36 extends to sidewall 20 where interemediate oblique caiming wall 36 joins interior lateral camming wall 40 which is parallel with a portion of sidewall 20. Interior lateral camming wall 40 joins second lower oblique camming wall 42 which extends inwardly adjacent from the intersection of sidewall 20 and lower wall 22.

First lower oblique camming wall 34 joins first lower interior oblique camming wall 44 at generally a right angle. Lower interior oblique camming wall 44 rises obliquely and joins central interior vertical camming wall 46 which rises to apex 48. Apex 48 and second lower oblique camming wall 42 are joined by second lower interior oblique camming wall 50 which, in turn, joins second lower oblique camming wall 42.

Island 52 is formed at a central portion of latching body 12 in interior area 54 bounded by the various camming walls. Island 52 divides interior area 54 into inlet channel 56 and outlet channel 58. The upper portion of island 52 (in the orientation of FIG. 2) is formed by first and second upper island camming walls 60, 62 which form a convex structure. The lower portion of island 52 is formed by first and second lower detent walls 64, 66. The intersection of first and second lower detent walls 64, 66 forms inverted-V detent element 67. Island 52 is bounded on the sides by sidewall 68 which joins the lower portion of first upper island camming wall 60 to the lower portion of the first lower detent wall 64 and sidewall 70 which joins the lower portion of second upper island camming wall 62 to the blunted edge 72 of the lower portion of the second lower detent wall 66.

As shown in FIGS. 1–4, guide prongs 74, 76 extend from the underside 15 of planar base 14 on both ends of upper wall 16 to engage slot 102 on body 100 and, likewise, guide prongs 78, 80 extend from the underside 15 of planar base 14 on both ends of lower wall 22 to engage slot 104 on body 100. Guide prongs 74, 76, 78, 80 include outwardly facing detent ledges 82, 84, 86, 88, respectively, which are spaced from underside 15 of planar base 14 by a distance substantially equal to or slightly greater than the thickness of body 100. Additionally, the distal ends 90, 91, 92, 93 of guide prongs 74, 76, 78, 80 are formed with points. This allows the guide prongs 74, 76, 78, 80 to be snap fitted into slots 102, 104 of body 100 and allows latching body 12 to slidingly traverse within slots 102, 104. Ridges 94, 96 may be formed on the underside 15 of planar base 14 in the direction of travel of latching body 12 in order to lift planar base 14 from body 100 and reduce the friction therebetween.

The position and length of slots 102, 104 is chosen so that the pin 200 enters mouth 24 at a position between position A (when latching body 12 is its rightmost position within slots 102, 104) and position L (when latching body 12 is at its leftmost position within slots 102, 104) as shown in FIG. 5. This is achieved by having the distance of travel of latching body 12 within slots 102, 104 no greater than the width of mouth 24 less the width of pin 200. The length of slots 102, 104 is therefore no greater than the width of latching body 12 plus the width of mouth 24 less the width of pin 200.

Pin 200 is typically diamond-shaped and travels along a generally vertical path in the orientation shown in FIG. 5. That is, the relative horizontal movement of pin 200 with respect to latching body 12 illustrated in FIG. 5 is the result of horizontal movement of latching body 12 within slots 102, 104 while the relative vertical movement of pin 200 with respect to latching body 12 is caused by the movement of pin 200, such as when the door or other structure (not shown) to which pin 200 is attached is moved.

When pin 200 enters mouth 24 at position A as shown in FIG. 5 (that is, when latching body 12 is at its rightmost position), the downward urging of pin 200 against second upper oblique camming wall 32 urges latching body 12 leftward until the relative position of pin 200 to latching body 12 is illustrated in position B. The continued downward urging of pin 200 through inlet channel 56 results in pin 200 being in position C. Position D is then reached by the continued downward movement of pin 200 and the urging of pin 200 against first lower oblique camming wall 34.

Pin 200 likewise reaches position D when pin 200 enters from position L in FIG. 5. The contact between pin 200 and first upper oblique camming wall 28 urges latching body 12 rightward and pin 200 travels to position K. Pin 200 then continues downward to position J. Contact between pin 200 and first upper island camming wall 60 of island 52 urges latching body 12 rightward until pin 200 is in inlet channel 56. Pin 200 then descends to position C. Position D is then reached by the continued downward movement of pin 200 and the urging of pin 200 against first lower oblique camming wall 34.

If pin 200 enters mouth 24 at any position between position A and position L, similar intermediate paths are taken involving camming actions by some combination of first and second upper oblique camming surfaces 28, 32 and/or first upper island camming wall 60 along with first lower oblique camming wall 34.

After pin 200 reaches position D, the user feels that the pin is fully inserted and therefore releases pressure thereon. The biasing force of pin 200 then urges pin 200 upward to position E where the upper corner of pin 200 engages first lower detent wall 64. It is important that sidewall 68 of island 52 is to the left of the intersection of first lower oblique camming wall 34 and lower interior oblique camming wall 44 so that pin 200 engages first lower detent wall 64 after being released from position D rather than re-entering inlet channel 56. Central interior vertical camming wall 46 prevents excessive leftward movement of latching body 12 as pin 200 rises from position D to position E. The continued upward biased urging of pin 200 against first lower detent wall 64 urges latching body 12 leftward until pin 200 reaches position F and engages inverted-V detent element 67 at the intersection of first and second lower detent walls 64, 66. When pin 200 is in position F, pin 200 is latched against latching body 12. In order to perform this latching operation through the various positions, the user has merely closed the door or other structure (not shown) to which pin 200 is attached, and then released the door when it would close no further (position D).

In order to remove pin 200 from the latched position F in FIG. 5, the user again pushes the door or other structure (not shown) to which the pin 200 is attached as if to close it more tightly (hence, the "push—push" structure). This urges pin 200 downwardly from position F to position G. In order to assure that pin 200 travels to the right of apex 48 to reach position G rather than to the left of apex 48 to position D or E during the unlatching cycle, it is important that apex 48 be further left than inverted-V detent element 67 of island 52 (again, "left", "right", "up" and "down" are used with respect to the orientation of FIG. 5). The continued downward urging of pin 200 against second lower interior oblique camming wall 50 urges latching body 12 leftward until pin 200 reaches position H. At this point, the user again feels that the door or other structure (not shown) to which pin 200 is attached is pushed as far as it will go. The user then releases the door or other structure (not shown) to which pin 200 is attached and the upward biasing of pin 200 urges pin 200 upward through outlet channel 58 with a slight camming action against blunted edge 72 thereby urging latching body leftward resulting in pin 200 reaching position I. It is important that blunted edge 72 is to the left of the intersection of second lower oblique camming wall 42 and second lower interior oblique camming wall 50 so that pin 200 can rise from position H to position I without engaging island 52 and possibly returning to position F. It is additionally important that interior lateral camming wall 40 is not further to the right that the uppermost tip of first upper oblique camming surface 28 as the proper operation of latch mechanism 10 requires that the movement of latching body 10 within slots 102, 104 does not result in pin 200 being so far to the left as to not engage first upper oblique camming surface 28.

The continued upward urging of pin 200 against intermediate oblique camming wall 36 urges latching body 12 rightward until pin 200 reaches position K. Pin 200 then travels upward free of contact with latching body 12. The door or other structure (not shown) to which pin 200 is attached therefore opens freely.

To install latch 10, the installer snap fits guide prongs 74, 76, 78, 80 of latching body 12 into slots 102, 104 on body 100 and installs pin 200 so that it engages mouth 24 between positions A and L of latching body 12 of FIG. 5 regardless of the position of latching body 12 within slots 102, 104.

To operate latch 10, the user merely pushes the door to latch the door and pushes the door again to unlatch the door as described above.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A latch mechanism for latching a door to a relatively stationary object including:

a latching body;

a protrusion, said protrusion engaging said latching body upon completion of a latching cycle and said protrusion being free of said latching body upon completion of an unlatching cycle;

said latching body including:

a mouth into which said protrusion enters, an inlet channel in communication with said mouth, an outlet channel in communication with said mouth, said mouth forming an entry to the latch body at one end and an exit to said inlet channel and said outlet channel at the other end, said mouth exit being aligned with said inlet channel in the direction of the protrusion travel, and said mouth exit not being larger than then the inlet channel entryway so that said protrusion is directed and funneled into said inlet channel, a detent means for engaging said protrusion, a first camming means for directing said protrusion from said mouth to said inlet channel during a latching cycle, a second camming means for directing said protrusion from said inlet channel to said detent means during a latching cycle, and a third camming means for directing said protrusion from said detent means to said outlet channel during an unlatching cycle.

2. The latch mechanism of claim 1 wherein a first of said latching body and said protrusion are adapted to be attached to the door and a second of said latching body and said protrusion are adapted to be attached to the relatively stationary object.

3. The latch mechanism of claim 2 wherein said latching body and said protrusion are relatively movable with respect to each other in first and second paths, said first and second paths being substantially orthogonal to each other.

4. The latch mechanism of claim 3 wherein one of said latching body and said protrusion includes means for traversing at least one slot along said first path.

5. The latch mechanism of claim 4 wherein relative movement along said second path is effected by a user urging the door.

6. The latch mechanism of claim 5 wherein said protrusion is secured to said door and said latching body traverses said at least one slot within said relatively stationary body.

7. The latch mechanism of claim 6 wherein said latching body is formed on a substantially rectangular planar body including sidewalls rising from planar body, an interior of said sidewalls defining at least a portion of said mouth, said first camming means, said second camming means and said third camming means.

8. The latch mechanism of claim 7 wherein an interior area is formed within said sidewalls of said substantially rectangular planar body, and wherein an island is formed within said interior area, said island dividing said inlet channel from said outlet channel within said interior area.

9. The latch mechanism of claim 8 wherein said island includes first walls and second walls, said first walls forming a concave structure generally facing said second and third camming means, said concave structure forming said detent means, said second walls forming a convex structure generally facing said mouth and forming at least another portion of said first camming means.

10. The latch mechanism of claim 9 wherein, during a latching cycle, a user pushes the door to urge said protrusion into said mouth to engage said first camming means thereby directing said protrusion into said inlet channel and said second camming means, the user thereafter releases the door and said protrusion travels to said detent means; and wherein, during an unlatching cycle, a user pushes the door to urge said protrusion from said detent means to said third camming means, the user thereafter releases the door and said protrusion travels through said outlet channel and out of said mouth.

11. The latch mechanism of claim 10 wherein said latching body includes guide prongs which engage said at least one slot in the relatively stationary body.

12. The latch mechanism of claim 11 wherein said guide prongs include detent ledges for engaging an underside of said at least one slot in the relatively stationary body.

13. The latch mechanism of claim 12 wherein said guide prongs further include pointed distal ends to provide a snap fit between said latching body and said at least one slot.

14. The latch mechanism of claim 13 wherein said at least one slot is of a length which limits travel of said latching body to a range wherein said protrusion engages said mouth.

15. The latch mechanism of claim 14 wherein a dividing wall and an apex thereof are positioned between said second camming means and said third camming means, said dividing wall guiding said protrusion from said second camming means to said detent means during the latching cycle and said apex guiding said protrusion from said detent means to said third camming means during the unlatching cycle.

* * * * *